United States Patent [19]

Horino et al.

[11] 4,406,404

[45] Sep. 27, 1983

[54] DIESEL FUEL INJECTION NOZZLE

[75] Inventors: Ippei Horino; Yuzo Tsumura; Masatoshi Iwata, all of Oyama, Japan

[73] Assignee: Kabushiki Kaisha Komatsu Seisakusho, Tokyo, Japan

[21] Appl. No.: 270,635

[22] Filed: Jun. 4, 1981

[30] Foreign Application Priority Data

Jun. 12, 1980 [JP] Japan ..... 55-78341

[51] Int. Cl.[3] ..... F02M 61/04

[52] U.S. Cl. ..... 239/91; 123/532; 239/95; 239/406; 239/409

[58] Field of Search ..... 123/531, 532, 294; 239/87-89, 91, 93-95, 407-411, 405, 406

[56] References Cited

U.S. PATENT DOCUMENTS

| | | | |
|---|---|---|---|
| 1,333,612 | 3/1920 | Fisher | 239/95 X |
| 1,898,763 | 2/1933 | Cowardin et al. | 239/95 X |
| 2,043,146 | 6/1936 | Baumheckel | 123/532 X |
| 2,796,058 | 6/1957 | Perkins | 239/87 |

*Primary Examiner*—Andres Kashnikow
*Attorney, Agent, or Firm*—Armstrong, Nikaido, Marmelstein & Kubovcik

[57] ABSTRACT

A nozzle for the air injection of fuel into the combustion chamber of a diesel engine cylinder. Included is a plunger reciprocably mounted in a nozzle body to define an air chamber for receiving compressed air from the combustion chamber during the compression stroke of the piston in the engine cylinder. Formed integral with the plunger, a needle valve defines within the nozzle body a fuel chamber for receiving fuel to be injected. A nozzle tip secured to the nozzle body founds a premixing chamber open directly to the combustion chamber and further in communication with both air chamber and fuel chamber. Thus, upon descent of the plunger at the end of the compression stroke, the fuel from the fuel chamber is intimately premixed in the premixing chamber with the compressed air from the air chamber, prior to introduction into the combustion chamber.

8 Claims, 4 Drawing Figures

FIG. 2
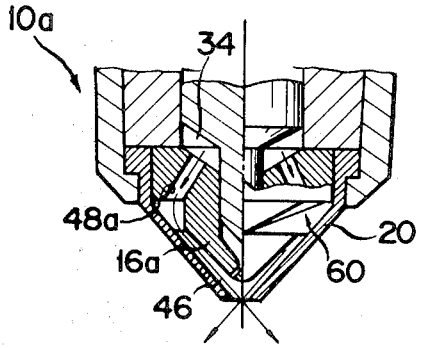
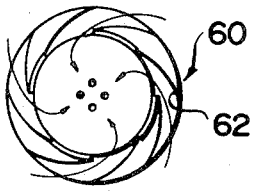
FIG. 3
FIG. 4
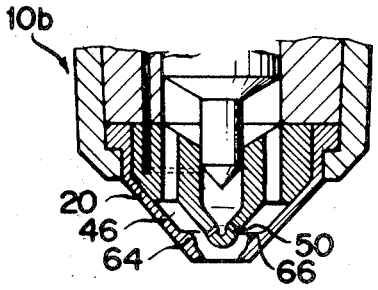

DIESEL FUEL INJECTION NOZZLE

BACKGROUND OF THE INVENTION

This invention relates to engine fuel injection equipment in general and, in particular, to a fuel injection nozzle for atomizing and spraying each metered charge of fuel, premixed with air, into the combustion chamber of a diesel engine cylinder.

Some early diesel engines employed an air-injection system, such that the fuel was atomized into the cylinder under air pressure. Although the system admittedly provided excellent smokefree combustion, it required expensive and bulky multistage compressors and intercoolers for injection air. Consequently, with the advent of spray nozzles capable of sufficiently atomizing the fuel by use of fuel pressure alone, the solid or airless injection has become the generally accepted method of fuel injection in compression-ignition engines.

Recently, however, it is being contemplated to inject fuel into diesel engine cylinders at pressures in the order of 1000 kgf/cm$^2$, with a view to higher engine efficiency and minimal exhaustion of air pollutants. The usual airless injection method does not necessarily provide good combustion at such ultrahigh pressures.

SUMMARY OF THE INVENTION

The present invention aims at the provision of an improved diesel fuel injection nozzle, based on the air injection principle, which is capable of finely atomizing and vaporizing the fuel and intimately mixing it with air to provide optimum combustion in engine cylinders. The invention also seeks to eliminate the need for bulky and expensive equipment conventionally required for injection air.

The improved diesel fuel injection nozzle according to this invention includes a plunger reciprocably mounted in a nozzle body and defining in combination therewith an air chamber for receiving compressed air from the combustion chamber of a diesel engine cylinder. The plunger reciprocates simultaneously with a valve member which is also mounted in the nozzle body and which defines in combination therewith a fuel chamber for receiving fuel to be injected. Both the air chamber and the fuel chamber communicate via suitable passages with a premixing chamber which is directly open to the combustion chamber of the diesel engine cylinder through a spray hole.

The air chamber receives compressed air from the combustion chamber through the premixing chamber during the compression stroke of the piston in the engine cylinder, whereas at the same time the fuel chamber receives fuel under relatively low pressure from a suitable fuel supply. As the plunger is pressed in a direction to reduce the capacities of the air and fuel chambers at the end of the compression stroke, the charge of fuel in the fuel chamber is expelled by the valve member into the premixing chamber, where the fuel is atomized by and mixed with the high speed streams of highly compressed air from the air chamber. The fuel thus premixed with the compressed air is then injected into the combustion chamber in a fine spray to ignite the compressed air therein.

Essentially, the premixing chamber forms a flow path of the highly compressed air from the air chamber back into the combustion chamber, and the fuel is forced into this flow path of the compressed air from the fuel chamber through restricted passages or orifices. The fuel can therefore be finely atomized and vaporized and intimately mixed with the air under pressure as it flows from the premixing chamber into the combustion chamber. It is particularly noteworthy that the invention utilizes the compressed air from the combustion chamber for atomizing and vaporizing the fuel prior to its injection into the combustion chamber, thus dispensing with any external source of such air.

The above and other objects, features and advantages of this invention and the manner of attaining them will become more apparent, and the invention itself will best be understood, from the following description and appended claims taken in connection with the attached drawings.

BRIEF DESCRIPTION OF THE DRAWINGS

FIG. 2 is a fragmentary, axial sectional view of a modified diesel fuel injection nozzle in accordance with the invention;

FIG. 3 is a plan view of a ring member incorporated in the modified nozzle of FIG. 2 to impart spiral motion to the compressed air, and therefore to the fuel, to be introduced into the diesel engine cylinder; and FIG. 4 is a fragmentary, axial sectional view of another modified diesel fuel injection nozzle in accordance with the invention.

DESCRIPTION OF THE PREFERRED EMBODIMENTS

Figure 1:
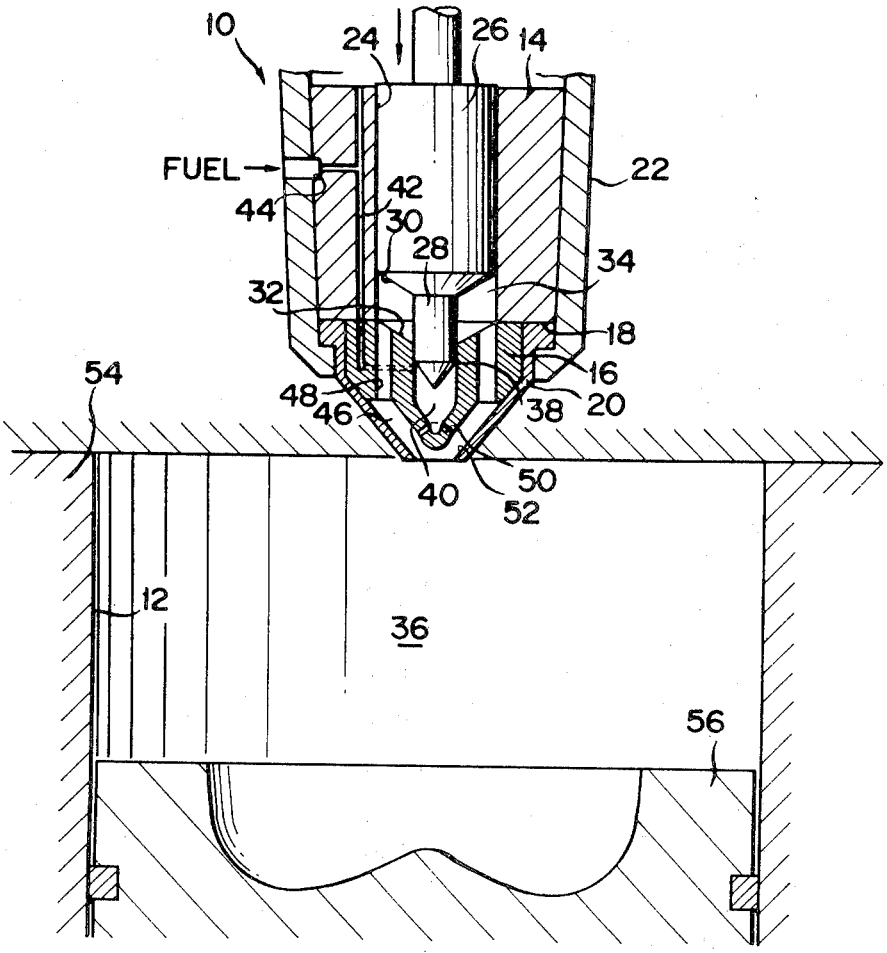
FIG. 1 is an axial sectional view of the diesel fuel injection nozzle constructed in accordance with the present invention, shown together with a fragmentary section of a diesel engine cylinder into which the fuel is to be injected by the nozzle.

The present invention will now be described more specifically in terms of a first preferred embodiment thereof illustrated in FIG. 1. Generally designated 10, the fuel injection nozzle according to the invention is therein shown mounted in position on a diesel engine cylinder 12. The nozzle 10 comprises a body 14 of substantially cylindrical or tubular shape, a cap 16 held against the bottom surface 18 of the nozzle body, and a nozzle tip 20 enclosing the cap. A nozzle retainer nut 22 holds the nozzle body 14, the cap 16 and the nozzle tip 20 in the relative positions described and secures them to a nozzle holder, not shown, by making threaded engagement therewith. Although the nozzle body 14 and the cap 16 are shown as separate units, the cap should be considered integral part of the nozzle body for the purposes of the invention.

The nozzle body 14 has a bore 24 formed axially therethrough. Slidably mounted in this bore for up-and-down reciprocation is a plunger 26 which is shown to be formed integral with a needle valve 28 of reduced diameter extending downwardly therefrom in axial alignment, with a shoulder 30 formed therebetween. Between this shoulder and the opposed top surface 32 of the cap 16 there is defined an air chamber 34 for receiving compressed air from the combustion chamber 36 of the diesel engine cylinder 12. The needle valve 28 is slidably fitted in a bore 38 in the cap 16 to define a fuel chamber 40 in communication with a suitable diesel fuel supply, not shown, by way of a passageway 42 and a fuel inlet 44. The fuel can be delivered to the fuel chamber 40 under relatively low pressure.

The plunger 26 together with the integral needle valve 28 is normally held in a raised position, as illustrated, by a spring, not shown. The plunger-valve combination is to be pressed against the force of the unshown spring by a suitable actuating mechanism such as a rocker arm and pushrod driven by the engine camshaft. The actuating mechanism is also not shown because of its rather conventional nature.

The nozzle tip 20 defines a substantially funnel-shaped premixing chamber 46 in combination with the cap 16. In this premixing chamber the fuel from the fuel chamber 40 is to be intimately premixed with and finely atomized by the compressed air from the air chamber 34, prior to injection into the combustion chamber 36. Thus the premixing chamber 46 communicates with the air chamber 34 via a plurality of angularly spaced, parallel passages 48 and with the fuel chamber 40 via a plurality of small diameter passages or orifices 50. A spray hole 52 in the nozzle tip 20 directly communicates the premixing chamber 46 with the combustion chamber 36. It should be noted that the orifices 50 are open to the premixing chamber 46 at points intermediate the ends of the premixing chamber with respect to the flow of the compressed air therethrough from the passages 48 to the spray hole 52.

The reference numeral 54 designates the cylinder block of the diesel engine under consideration. The cylinder 12 formed in the cylinder block 54 has a piston 56 reciprocably mounted therein so as to define the combustion chamber 36.

In operation, let it be assumed that the plunger 26, as well as the needle valve 28, of the fuel injection nozzle 10 is now in the illustrated raised position, and that the piston 56 in the engine cylinder 12 is lowered, ready to start travelling upwardly on its compression stroke, also as depicted in FIG. 1. The diesel fuel is delivered under relatively low pressure from its unshown source to the fuel chamber 40 via the inlet 44 and passageway 42, to be temporarily stored therein, while the plunger 26 is raised. Also, as the piston 56 travels upwardly on the compression stroke, part of the compressed air in the combustion chamber 36 flows into, and is temporarily stored in, the air chamber 34 via the spray hole 52, premixing chamber 46, and passages 48.

The plunger 26 is pressed down by the unshown actuating mechanism at the end of the compression stroke. Descending with the plunger 26, the needle valve 38 forces the diesel fuel in the fuel chamber 40 out into the premixing chamber 46 via the orifices 50. The plunger itself also expels the compressed air from the air chamber 34 into the premixing chamber 46 via the passages 48 at high speed. Thus in the premixing chamber the high speed streams of compressed air atomizes and intimately mingles with the fuel issuing from the orifices 50. The fuel-air mixture is subsequently sprayed from the spray hole 52 into the combustion chamber 36 of the engine cylinder 12, therein to be ignited by the air compressed to a high temperature.

It should be appreciated that the compressed air in the air chamber 34 undergoes further compression and a consequent temperature rise when forced out into the premixing chamber 46 by the descending plunger 26. Such high temperature air promotes the vaporization of the fuel in the premixing chamber. Further the air streams from the air chamber 34 have such high speed that the fuel can be thoroughly mixed with the air and injected into the combustion chamber in a fine spray. Still further, for all these advantages offered by the high speed streams of air under pressure, the invention requires no source of such air external to the engine proper.

FIG. 2 illustrates a modified diesel fuel injection nozzle 10*a*, which incorporates a ring 60 mounted within the nozzle tip 20 and encircling part of a cap 16*a* of slightly modified shape. As better seen in FIG. 3, the ring 60 is configured to define spiral passages 62 through which air passages 48*a* in the cap 16*a* communicate with the premixing chamber 46. The other details of construction of this modified nozzle 10*a* can be essentially identical with those of the nozzle 10 of FIG. 1.

Thus, as the plunger is depressed at the end of each compression stroke, the passages 62 in the ring 60 function to impart spiral motion to the compressed air flowing therethrough from the air chamber 34 to the premixing chamber 46. The sprial flow of the air in the premixing chamber serves to increase the relative velocities of air and fuel streams and to give spiral motion to the fuel as well. The fuel can therefore be more intimately mixed with the air, and atomized to a still higher degree, before entering the combustion chamber.

FIG. 4 gives another modified diesel fuel injection nozzle 10*b*, which is analogous with the nozzle 10 of FIG. 1 except for an annular ridge 64 formed on the inside surface of the nozzle tip 20 and in the vicinity of the orifices 50. This annular ridge is intended to create a restriction 66 in the premixing chamber 46. The restriction 66 serves to increase the velocity of flow for more favorable spraying of the fuel-air mixture into the combustion chamber, by the venturi effect.

The foregoing description of some specific embodiments is meant purely to illustrate or explain and not to impose limitations upon the invention, since various modifications or alterations of the invention may be resorted to within the proper scope of the invention. For example, the spiral air passages of FIGS. 2 and 3 may be combined with the premixing chamber restriction of FIG. 4 in a single diesel fuel injection nozzle.

What we claim is:

1. A fuel injection nozzle for the delivery of fuel, premixed with air under pressure, to the combustion chamber of a diesel engine cylinder, comprising:

(a) a nozzle body;

(b) a plunger reciprocably mounted in the nozzle body and defining in combination therewith an air chamber for receiving compressed air from the combustion chamber of a diesel engine cylinder;

(c) a valve member formed integrally with and reciprocable simultaneously with the plunger in the nozzle body, the valve member and nozzle body defining in combination a fuel chamber for receiving fuel to be injected;

(d) means defining a premixing chamber open to the combustion chamber of the diesel engine cylinder;

(e) there being passages communicating the air chamber and the fuel chamber with the premixing chamber, so that the fuel from the fuel chamber is injected into the combustion chamber after being premixed in the premixing chamber with the compressed air from the air chamber.

2. A diesel fuel injection nozzle according to claim 1, wherein the premixing chamber is substantially funnel-shaped.

3. A diesel fuel injection nozzle according to claims 1 or 2, wherein the fuel chamber communicates with the premixing chamber via a plurality of orifices.

4. A diesel fuel injection nozzle according to claim 3, wherein the orifices are open to the premixing chamber at points intermediate the ends of the premixing chamber with respect to the flow of the compressed air therethrough.

5. A diesel fuel injection nozzle according to claim 1, wherein the valve member is a needle valve in axial alignment with the plunger.

6. A diesel fuel injection nozzle according to claim 1, further comprising means for imparting spiral motion to the compressed air flowing from the air chamber to the premixing chamber.

7. A diesel fuel injection nozzle according to claims 1 or 6, wherein the premixing chamber has a restriction for increasing the velocity of the premixed fuel and air.

8. A diesel fuel injection nozzle according to claim 1, wherein the premixing chamber is substantially funnel-shaped, wherein the fuel chamber communicates with the premixing chamber via a plurality of orifices which are open to the premixing chamber at points intermediate its ends with respect to the flow of the compressed air therethrough, and wherein the premixing chamber has an annular restriction formed in the vicinity of the orifices for increasing the velocity of the premixed fuel and air.

* * * * *